US007926311B2

(12) United States Patent
Mani et al.

(10) Patent No.: US 7,926,311 B2
(45) Date of Patent: Apr. 19, 2011

(54) INTEGRAL LAUNDRY CLEANING AND DRYING SYSTEM AND METHOD

(75) Inventors: Vanita Mani, Clifton Park, NY (US); Darren L. Hallman, Clifton Park, NY (US); Olga K. Zhushma, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1995 days.

(21) Appl. No.: 10/676,903

(22) Filed: Oct. 1, 2003

(65) Prior Publication Data

US 2005/0071929 A1 Apr. 7, 2005

(51) Int. Cl.

| | |
|---|---|
| ***D06F 29/00*** | (2006.01) |
| ***D06F 35/00*** | (2006.01) |
| ***D06F 43/00*** | (2006.01) |

(52) U.S. Cl. ..... 68/19; 68/12.08

(58) Field of Classification Search ..... 68/12.01, 68/159, 12.08, 12.09, 12.11, 12.13, 12.15, 68/12.19, 18 R, 18 C, 18 F, 19, 207

See application file for complete search history.

(56) References Cited

U.S. PATENT DOCUMENTS

| | | | | |
|---|---|---|---|---|
| 3,739,487 | A | 6/1973 | Clark | |
| RE31,633 | E | 7/1984 | Lewis | |
| 4,603,489 | A * | 8/1986 | Goldberg | 34/77 |
| 4,685,930 | A | 8/1987 | Kasprzak | 8/139.1 |
| 5,213,594 | A * | 5/1993 | Cannon et al. | 95/90 |
| 5,887,454 | A * | 3/1999 | Renzacci | 68/18 C |
| 5,942,007 | A | 8/1999 | Berndt et al. | 8/142 |
| 6,042,617 | A | 3/2000 | Berndt | 8/142 |
| 6,042,618 | A | 3/2000 | Berndt et al. | 8/142 |
| 6,056,789 | A | 5/2000 | Berndt et al. | 8/142 |
| 6,059,845 | A * | 5/2000 | Berndt et al. | 8/142 |
| 6,063,135 | A | 5/2000 | Berndt et al. | 8/142 |
| 6,086,635 | A * | 7/2000 | Berndt et al. | 8/142 |
| 6,309,425 | B1 | 10/2001 | Murphy | 8/142 |
| 6,313,079 | B1 | 11/2001 | Murphy | 510/285 |
| 6,748,772 | B2 | 6/2004 | Lee et al. | |
| D527,150 | S * | 8/2006 | Jun | D32/6 |
| 2003/0196277 | A1 * | 10/2003 | Hallman et al. | 8/142 |
| 2003/0208923 | A1 | 11/2003 | Lewis | |

FOREIGN PATENT DOCUMENTS

WO WO0111134 A1 * 2/2002

* cited by examiner

*Primary Examiner* — Michael Barr
*Assistant Examiner* — Jason Y Ko
(74) *Attorney, Agent, or Firm* — Patrick K. Patnode

(57) ABSTRACT

The present technique provides systems and methods for integrally washing and drying laundry articles in a home application. Certain embodiments provide a home laundry machine having a drying mechanism pneumatically coupled to a laundry enclosure via an air inlet and an air outlet. The drying mechanism comprises a heating device disposed upstream of the air inlet and a cooling device disposed downstream of the air outlet.

24 Claims, 7 Drawing Sheets

INTEGRAL LAUNDRY CLEANING AND DRYING SYSTEM AND METHOD

BACKGROUND OF THE INVENTION

Household laundry systems currently comprise a washing machine and a separate drying machine, which are individually adapted for household space limitations, electrical systems, gas supplies, and water supplies. Existing home washing machines generally use between 16 and 50 gallons of cold and/or hot water to wash a typical load of laundry articles. These home washing machines also use a variety of detergents, bleaches, and chemicals to improve the effectiveness of the washing process. Accordingly, the use of large quantities of water, heat for the water, and chemicals can result in high energy usage and environmental strains with conventional home washing machines. Similarly, home drying machines consume large quantities of energy in the form of electricity or natural gas. These home drying machines also exhaust various pollutants into the environment. In addition to the environmental strains and inefficiencies of current household laundry systems, the use of hot water, detergents, bleaches, and hot air can adversely wear and destroy the laundry articles being cleaned.

Accordingly, a technique is needed for improving efficiencies and reducing environmental impacts of the home laundry cleaning process.

BRIEF DESCRIPTION OF THE INVENTION

The present technique provides systems and methods for integrally washing and drying laundry articles in a home application. Certain embodiments provide a home laundry machine having a drying mechanism pneumatically coupled to a laundry enclosure via an air inlet and an air outlet. The drying mechanism comprises a heating device disposed upstream of the air inlet and a cooling device disposed downstream of the air outlet.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

As discussed in further detail below, certain embodiments of the present technique provide an integral home laundry washing and drying system, which comprises a closed loop washing system and a closed loop drying system. The integration of these washing and drying systems reduces the space consumption of the overall home laundry cleaning device and, also, improves the efficiency of the overall laundry cleaning process. For example, a user simply loads laundry articles into the integral system and runs a single laundry cleaning process, rather than loading laundry articles into a washing machine, running a washing process, removing the laundry articles from the washing machine, loading the laundry articles back into a separate laundry drying machine, running a laundry drying process, and finally removing the laundry articles. In addition, the closed loop washing system of the present technique facilitates the reuse of a laundry cleaning fluid, such as a cleaning solvent, and reduces or eliminates the drainage of fluid waste into the environment. The closed loop drying system of the present laundry cleaning device also reduces or eliminates the exhaust of air pollutants, such as airborne particulate waste, into the environment. In conjunction with the closed loop washing system, the closed loop drying system facilitates the recovery of evaporated cleaning fluids from the drying air flow passing through the laundry cleaning device and over the laundry articles.

Figure 1:
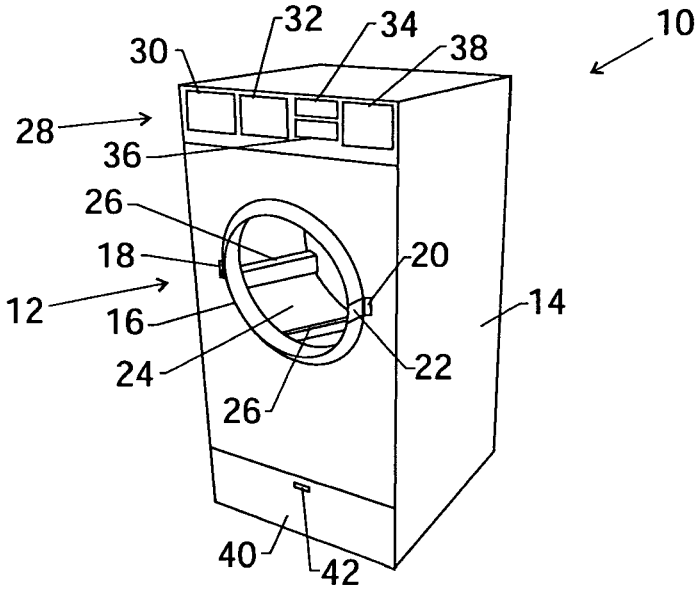
FIG. 1 is a perspective view of an exemplary home laundry cleaning device in accordance with certain embodiments of the present technique.

Embodiments of the present laundry cleaning system may have a variety of different components and configurations, such as a top loading laundry enclosure or a front loading laundry enclosure. Turning now to the drawings, FIG. 1 is a perspective view illustrating an exemplary home laundry machine or laundry cleaning device 10 in accordance with certain embodiments of the present technique. As illustrated, the laundry cleaning device 10 comprises a laundry enclosure 12 disposed within a housing 14. Although the laundry enclosure 12 can have a variety of configurations and forms, the illustrated laundry enclosure 12 is configured for front loading through a door 16. On one side, the door 16 is rotatably coupled to the housing 14 by a hinge 18. On the other side, the door 16 is removably coupled to the housing 14 via a latch 20 and a release handle 22.

Within the housing 14, the laundry enclosure 12 comprises a laundry receptacle 24 having a plurality of paddles or protruding members 26, which facilitate the agitation or movement of the laundry articles during operation of a particular laundry cleaning process. The laundry cleaning device 10 also has a user control panel 28 comprising a variety of user controls and displays, such as user controls 30, 32, 34, 36, and 38. As discussed in further detail below, the user control panel 28 is operatively coupled to a variety of control circuitry and mechanisms, which interact with the internal components of the laundry cleaning device 10 to facilitate an integral laundry washing and drying process.

As illustrated, the laundry cleaning device 10 also comprises an access panel 40, which is releasable by a release handle 42 to provide access to various components within the laundry cleaning device 10. For example, the access panel 40 may be released to perform maintenance, to fill the closed loop washing system with a desired cleaning fluid (e.g., a cleaning solvent), to charge a vapor compression cycle system, to change a fluid recovery mechanism (e.g., a water separator, a mechanical filter, a particulate, a water absorption device, or a cleaning fluid regeneration device), or to perform a variety of other servicing functions, as described in further detail below.

Figure 2:
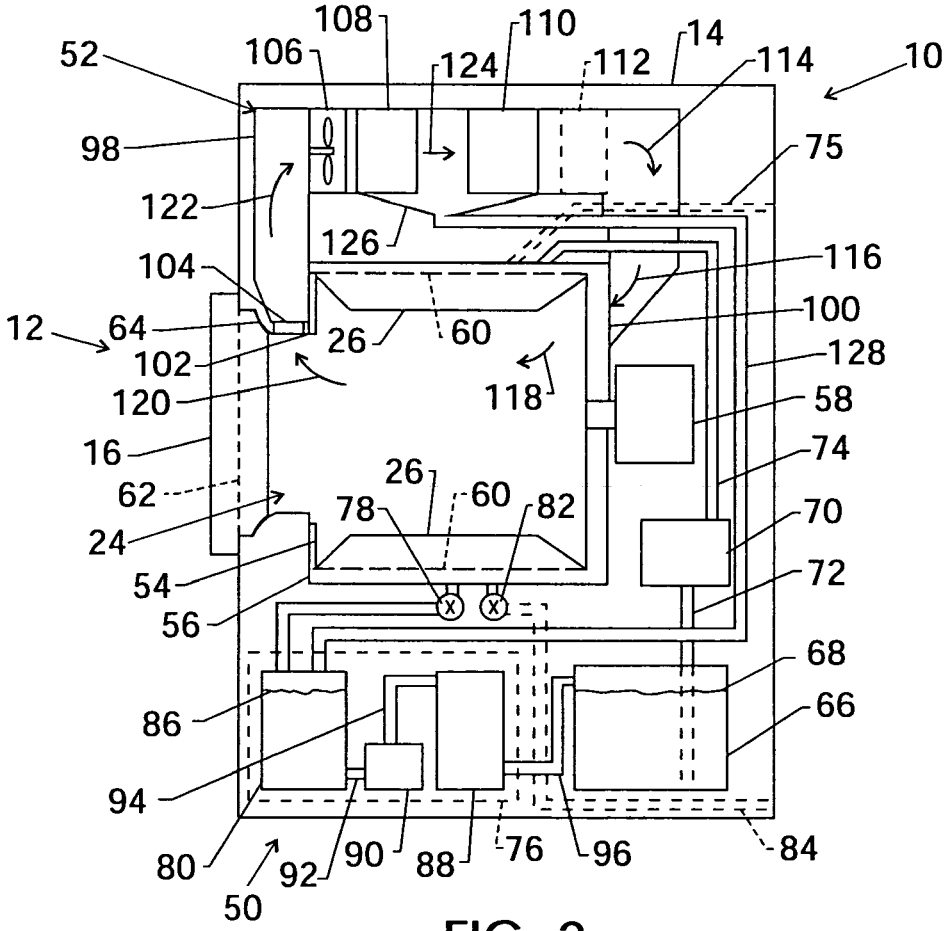
FIG. 2 is a side view of the laundry cleaning device of FIG. 1 illustrating internal closed loop drop drying and washing systems in accordance with certain embodiments of the present technique.

Turning now to FIG. 2, exemplary embodiments of a closed loop washing system 50 and a closed loop drying system 52 are illustrated in an internal side view of the laundry cleaning device 10. As illustrated, the laundry receptacle 24 comprises a moveable inner basket 54 disposed moveably within a closed outer housing 56. An agitation device 58, such as a motor, is coupled to the moveable inner basket 54 to facilitate movement of the basket 54 within the closed outer housing 56. For example, the control system of the laundry cleaning device 10 may operate the agitation device 58 to move the moveable inner basket 54 in a variety of rotational directions and speeds, such as a low speed rotational movement to facilitate tumbling of the laundry articles or a high speed rotational movement to facilitate centrifugal fluid extraction from the laundry articles. Accordingly, a plurality of the paddles or protruding members 26 are disposed on the moveable inner basket 54 to facilitate movement of the laundry articles as the agitation device 58 rotates the moveable inner basket 54.

In addition, the moveable inner basket 54 comprises a variety of holes or openings to facilitate the closed loop washing and drying systems 50 and 52. For example, the moveable inner basket 54 comprises perforated walls 60 to facilitate the entry and discharge of various cleaning fluids, such as a cleaning solvent (e.g., a cyclic siloxane composition). Although not illustrated, the moveable inner basket 54 may have additional perforations or openings to facilitate airflow through the closed loop drying system 52. Alternatively, the closed loop drying system 52 may force airflow through the openings of the perforated walls 60.

In either case, the closed loop drying system 52 is pneumatically coupled to the closed outer housing 56, while the door 16 closes and seals a front opening 62 of the closed outer housing 56 at an interface 64. With the door 16 closed, the closed loop drying system 52 operates to create a closed loop airflow that flows through the laundry receptacle 24. In the illustrated embodiment, the closed loop washing system 50 is also fluidly coupled to the laundry receptacle 24. With the door 16 closed, the closed loop washing system 50 can charge cleaning fluids into the laundry receptacle 24, perform a washing cycle, and recover the cleaning fluids for a subsequent washing cycle.

The closed-loop washing system 50 illustrated in FIG. 2 comprises a variety of washing components, which are fluidly coupled to the laundry receptacle 24. As illustrated, the closed loop washing system 50 comprises a cleaning fluid tank 66 for storing a cleaning fluid 68, such as a cleaning solvent (e.g., cyclic siloxane), which is used to clean laundry articles loaded within the laundry receptacle 24. In operation, a pump 70 draws the cleaning fluid 68 from the cleaning fluid tank 66 through a fluid conduit 72 and charges the cleaning fluid 68 into the laundry receptacle 24 through a fluid conduit 74. The laundry cleaning device 10 also may optionally charge the laundry receptacle 24 with one or more additional or alternative fluids, such as water, from an external fluid source 75. The closed loop washing system 50 then performs one or more washing cycles in which the agitation device 58 moves the inner basket 54 to soak the laundry articles with the cleaning fluid 68.

After sufficient agitation, the closed loop washing system 50 proceeds to extract a portion of the fluid out of the laundry articles and drain the fluid from the laundry receptacle 24 into a fluid recovery systems 76. In operation, the closed loop washing system 50 opens a fluid recovery valve 78 to drain the fluid into a fluid collection or recovery tank 80 of the fluid recovery systems 76.

The system 50 also may have a fluid drain valve 82 to facilitate fluid drainage from the laundry receptacle 24 and out of the laundry cleaning device 10 through fluid drainage conduit 84. For example, as discussed in further detail below, the laundry cleaning device 10 may utilize a variety of cleaning fluids, such as cleaning solvents, water, detergents, bleaches, and so forth. Accordingly, some of these cleaning fluids may be drained through the fluid drainage conduit 84, while others are recaptured by the fluid recovery system 76.

In the latter case of fluid recovery, the fluid recovery tank 80 collects a working fluid 86 from the laundry receptacle 24 and passes the working fluid 86 through a fluid recovery mechanism 88, which generally recovers the cleaning fluid 68 from the working fluid 86. As illustrated, a pump 90 draws the working fluid 86 from the fluid recovery tank 80 through a conduit 92 and transfers the working fluid into the fluid recovery mechanism 88 through a conduit 94. After the fluid recovery mechanism 88 processes the working fluid 86, the reconditioned cleaning fluid 68 is transferred back into cleaning fluid tank 66 through conduit 96. As discussed in further detail below, the fluid recovery mechanism 88 may comprise a variety of filters, fluid separators, fluid absorption devices, and other suitable processing mechanisms to recover the cleaning fluid 68 from the working fluid 86. The reconditioned cleaning fluid 68 can then be reused for subsequent washing cycles of the closed loop washing system 50.

The closed loop drying system 52 illustrated in FIG. 2 comprises a variety of drying components disposed within a closed conduit or air passageway 98, which is pneumatically coupled to the laundry receptacle 24 at an air inlet 100 and an air exhaust 102. The illustrated drying components comprise an air filter 104, a blowing device or fan 106, a chiller or cooling device 108, a heater or heating device 110, and a supplemental heating device 112. In operation, the fan 106 functions to force air through the conduit or air passageway 98 and the laundry enclosure 12 as a closed loop airflow, as indicated by airflow arrows 114, 116, 118, 120, 122, and 124. As the closed loop drying system 52 circulates this closed loop airflow, the heating device 110 and optional supplemental heating device 112 cooperatively function to heat the air passing into the laundry enclosure 12, thereby facilitating evaporation of cleaning fluids disposed within the laundry articles. As the airflow continues, the closed loop drying system 52 carries the evaporated or vaporized cleaning fluids into the conduit or air passageway 98 and through the chiller or cooling device 108, as illustrated by arrow 124. The chiller or cooling device 108 functions to chill the heated airflow and condense the vaporized cleaning fluids from the airflow, such that the condensed cleaning fluids can be recovered by a fluid collector 126 of the closed loop washing system 50. As illustrated, the condensed cleaning fluids are transferred to the fluid recovery system 108 through a fluid recovery conduit 128, which extends from the fluid collector 126 to the fluid recovery tank 80 for processing as discussed in detail above. After the closed loop drying system 52 recovers the vaporized cleaning fluids via the chiller or cooling device 108, the heating device 110 and the optional supplemental heating device 112 reheat the air for subsequent reentry into the laundry enclosure 12. Accordingly, the closed loop drying system 52 continuously heats the airflow, vaporizes the cleaning fluids, cools the airflow to recover the vaporized cleaning fluids, and then repeats the closed-loop by reheating the airflow.

Figure 3:
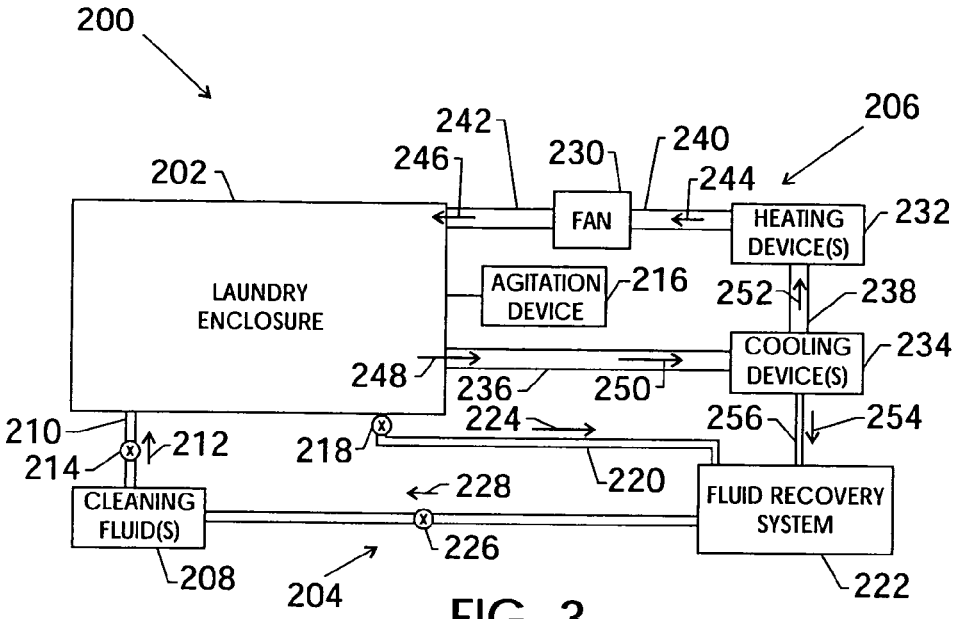
FIG. 3 is a block diagram illustrating an integral laundry washing and drying system in accordance with certain embodiments of the present technique.

FIG. 3 is a block diagram illustrating an integral laundry washing and drying system 200 in accordance with certain embodiments of the present technique. As illustrated, the system 200 comprises a laundry enclosure 202, a closed loop washing system 204 fluidly coupled to the laundry enclosure 202, and a closed loop drying system 206 pneumatically coupled to the laundry enclosure 202. The illustrated closed loop washing system 204 comprises a tank of cleaning fluid 208 coupled to the laundry enclosure 202 via a fluid conduit 210. As illustrated by arrow 212, the closed loop washing system 204 engages a pump and/or valve 214 to transfer the cleaning fluid 208 into the laundry enclosure 202. The cleaning fluid 208 may comprise a variety of cleaning detergents, solvents, bleaches, and washing agents. However, the illustrated embodiment comprises a solvent-based cleaning fluid 208, such as cyclic siloxane. In operation, the closed loop washing system 204 operates one or more washing cycles in which the solvent-based cleaning fluid 208 is worked into laundry articles disposed within the laundry enclosure 202. For example, the closed loop washing system 204 may engage an agitation device 216 to move or rotate the laundry articles within the laundry enclosure 202, thereby soaking the laundry articles with the solvent-based cleaning fluid 208. After sufficient agitation, the closed loop washing system 204 engages a fluid recovery pump and/or valve 218 to transfer the solvent-based cleaning fluid 208 from the laundry enclosure 202 through a fluid conduit 220 to a fluid recovery system 222, as indicated by arrow 224. The closed loop washing system 204 also may rotate the laundry enclosure 202 at a relatively high rotational velocity, thereby centrifuging the solvent based cleaning fluid 208 out of the laundry articles and into the fluid recovery system 222. As discussed in further detail below, the fluid recovery system 222 generally recovers or reconditions the solvent-based cleaning fluid 208 to a state that is reusable for a subsequent washing cycling. Upon completion, the closed loop washing system 204 engages a pump and/or valve 226 to transfer the recovered solvent-based cleaning fluid 208 from the fluid recovery system 222 to the tank of cleaning fluid 208, as indicated by arrow 228.

The illustrated closed loop drying system 206 functions cooperatively with the closed loop washing system 204 to recover the cleaning fluid 208 and to dry the laundry articles disposed within the laundry enclosure 202. As illustrated, the closed loop drying system 206 comprises a blowing device or fan 230, one or more heating devices 232, and one or more cooling devices 234. The foregoing devices 230, 232, and 234 are pneumatically coupled to the laundry enclosure 202 and to one another via air conduits 236, 238, 240, and 242, thereby forming a closed-loop airflow indicated by arrows 244, 246, 248, 250, and 252. In operation, the closed loop drying system 206 blows heated air (e.g., airflows 244 and 246) from the one or more heating devices 232 into the laundry enclosure 202, thereby substantially evaporating the remaining cleaning fluid 208 within the laundry articles. As indicated by airflows 248 and 250, the closed loop drying system 206 then exhausts the vaporized or evaporated cleaning fluid 208 from the laundry enclosure 202 to the cooling devices 234. The cooling devices 234 operate to cool the heated airflow, thereby condensing a substantial portion of the vaporized or evaporated cleaning fluid 208 out of the airflow. As indicated by fluid flow 254, the closed loop drying system 206 transports the recovered cleaning fluid 208 from the cooling devices 234 to the fluid recovery system 222 through a fluid recovery conduit 256. Again, the fluid recovery system 222 functions to process or recondition the recovered cleaning fluid 208 for subsequent reuse by the integral laundry washing and drying system 200. After the airflow is cooled by cooling devices 234, the heating devices 232 reheat the airflow for a subsequent loop through the closed loop drying system 206, as indicated by arrows 252 and 244. Accordingly, the closed loop drying system 206 repeatedly heats the airflow, evaporates the cleaning fluid 208 from the laundry articles in the laundry enclosure 202, and cools the airflow to condense and recover the evaporated cleaning fluid 208 until the laundry articles are substantially dry and the cleaning fluid 208 is substantially recovered by the fluid recovery system 222.

Figure 4:
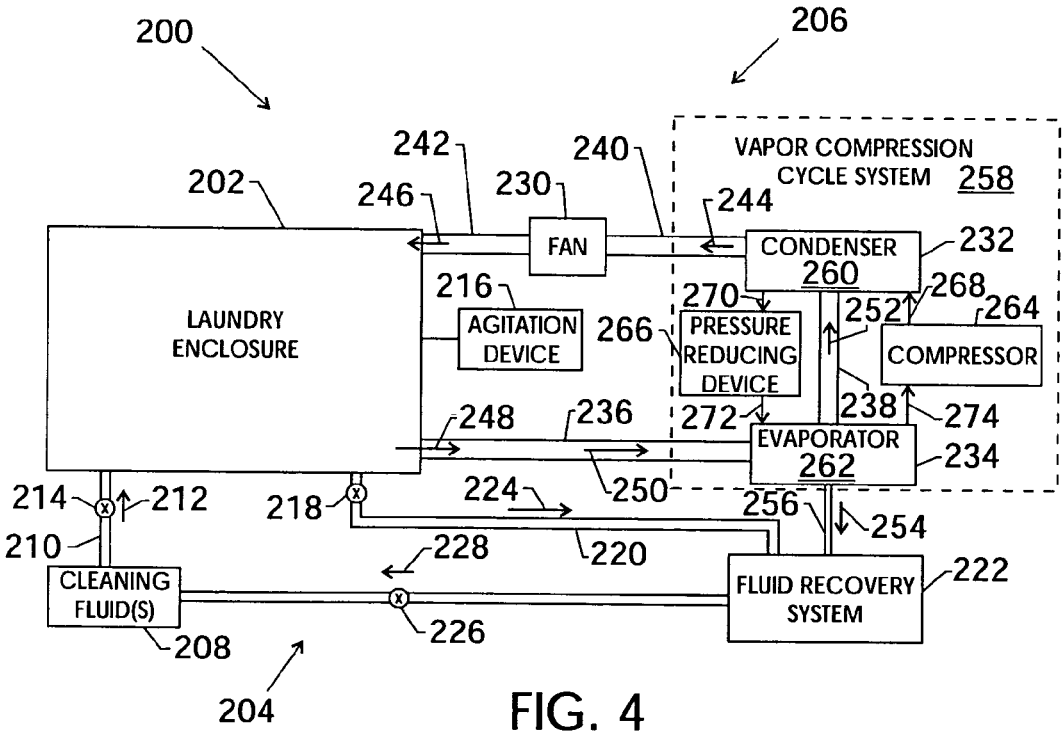
FIG. 4 is a block diagram illustrating an alternative embodiment of the integral laundry washing and drying system illustrated in FIG. 3 having a vapor compression cycle system.

FIG. 4 is a block diagram illustrating an alternative embodiment of the integral laundry washing and drying system 200 in accordance with certain embodiments of the present technique. As illustrated, the system 200 comprises the laundry enclosure 202, the closed loop washing system 204 fluidly coupled to the laundry enclosure 202, and the closed loop drying system 206 pneumatically coupled to the laundry enclosure 202. However, in the illustrated embodiment, the closed loop drying system 206 comprises a refrigeration or vapor compression cycle system 258 having a condenser 260, an evaporator 262, a compressor 264, and a pressure reducing device 266 coupled together by a closed loop conduit, as indicated by arrows 268, 270, 272, and 274. In operation of the closed loop drying system 206, the condenser 260 functions as the heating device 232, while the evaporator 262 functions as the cooling device 234.

Turning specifically to the vapor compression cycle system 258, the compressor 264 compresses a working fluid (e.g., a refrigerant such as fluorocarbon R-22) in the vapor phase, thereby causing the temperature of the working fluid to increase to a relatively high temperature. The vapor compression cycle system 258 then circulates the hot, high-pressure working fluid through the condenser 260 (e.g., condenser coils), which transfers heat from the working fluid into the airflow 244 of the closed loop drying system 206. As a result of the heat transfer in the condenser 260, the working fluid condenses from a vapor to liquid. The vapor compression cycle system 258 then passes the working fluid through the pressure reducing device 266 (e.g., throttling valve), which substantially reduces the pressure and the temperature of the working fluid. The cool, low-pressure working fluid then enters the evaporator 262 (e.g., evaporator coils), which transfers heat into the working fluid from the heated airflow 250 of the closed loop drying system 206. As a result of the heat transfer in the evaporator 262, the working fluid evaporates or changes state from a saturated mixture of liquid and vapor into a superheated vapor.

In operation, the closed loop drying system 206 of FIG. 4 blows airflows 244 and 246 heated by the condenser 260 into the laundry enclosure 202, thereby substantially evaporating the remaining cleaning fluid 208 within the laundry articles. As indicated by airflows 248 and 250, the closed loop drying system 206 then exhausts the vaporized or evaporated cleaning fluid 208 from the laundry enclosure 202 to the evaporator 262. The evaporator 262 then operates to cool the heated airflow, thereby condensing a substantial portion of the vaporized or evaporated cleaning fluid 208 out of the airflow. As indicated by fluid flow 254, the closed loop drying system 206 transports the recovered cleaning fluid 208 from the evaporator 262 to the fluid recovery system 222 through the fluid recovery conduit 256. The foregoing closed loop drying process then repeats.

Figure 5:
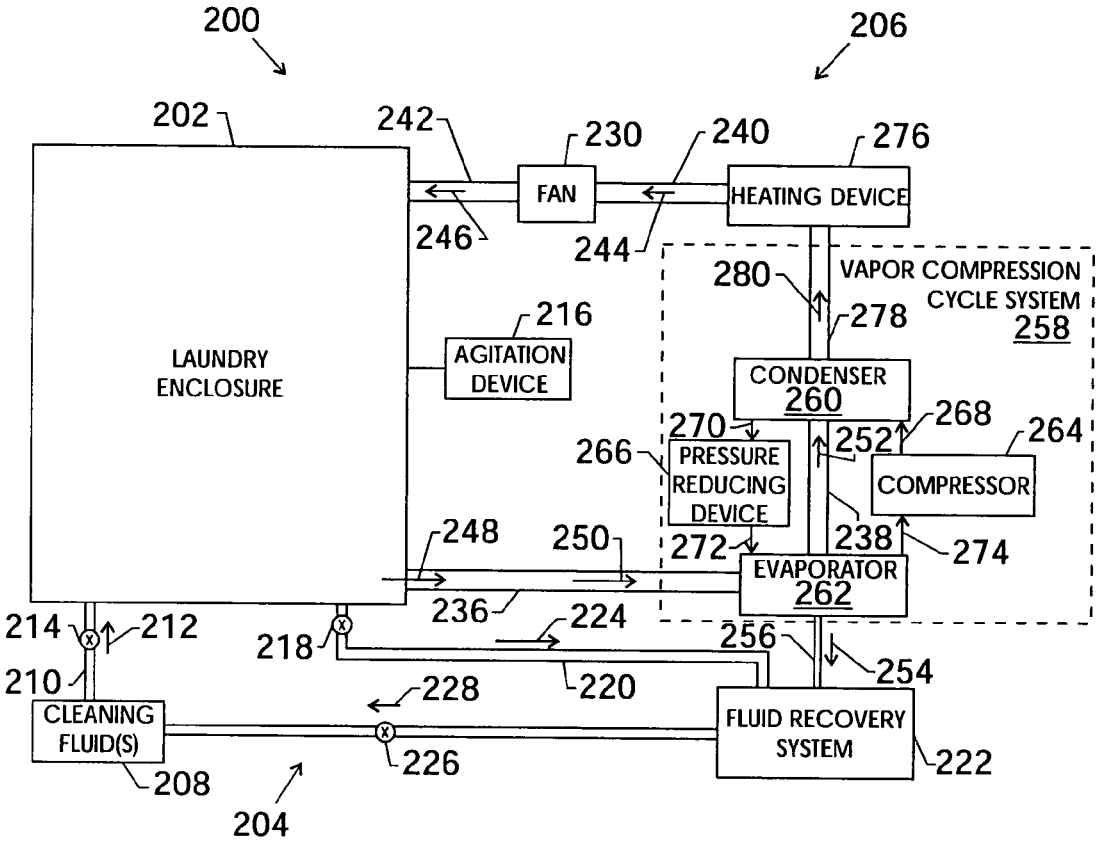
FIG. 5 is a block diagram illustrating a further alternative embodiment of the integral laundry washing and drying system illustrated in FIG. 3 having the vapor compression cycle system of FIG. 4 and a supplemental heating device.

FIG. 5 is a block diagram illustrating an alternative embodiment of the integral laundry washing and drying system 200 in accordance with certain embodiments of the present technique. As illustrated, the system 200 comprises the laundry enclosure 202, the closed loop washing system 204 fluidly coupled to the laundry enclosure 202, and the closed loop drying system 206 pneumatically coupled to the laundry enclosure 202. However, in the illustrated embodiment, the closed loop drying system 206 comprises the refrigeration or vapor compression cycle system 258 and a supplemental heating device 276, which is pneumatically coupled to the condenser 260 via conduit 278. The supplemental heating device 276 may comprise a resistive heating device, a combustion heating device, or any other suitable heating mechanism, which further heats airflow 280 heated by the condenser 260. In this manner, the condenser 260 and the supplemental heating device 276 cooperatively function as the heating devices 232.

In operation, the closed loop drying system 206 of FIG. 5 blows airflows 280, 244, and 246 heated by the condenser 260 and the supplemental heating device 276 into the laundry enclosure 202, thereby substantially evaporating the remaining cleaning fluid 208 within the laundry articles. As indicated by airflows 248 and 250, the closed loop drying system 206 then exhausts the vaporized or evaporated cleaning fluid 208 from the laundry enclosure 202 to the evaporator 262. The evaporator 262 then operates to cool the heated airflow, thereby condensing a substantial portion of the vaporized or evaporated cleaning fluid 208 out of the airflow. As indicated by fluid flow 254, the closed loop drying system 206 transports the recovered cleaning fluid 208 from the evaporator 262 to the fluid recovery system 222, which reconditions the recovered cleaning fluid 208 for a subsequent reuse by the closed loop washing system 204. The foregoing closed loop drying process then repeats.

Figure 6:
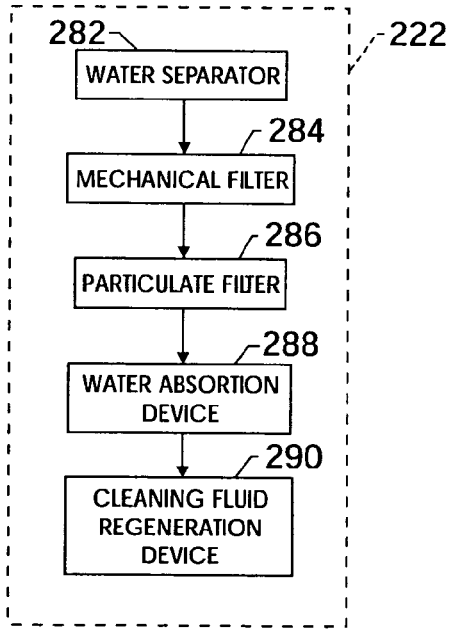
FIG. 6 is a block diagram illustrating an exemplary fluid recovery system of the integral laundry washing and drying systems illustrated in FIGS. 3-5.

Turning now to FIG. 6, an exemplary embodiment of the fluid recovery system 222 is illustrated for use in the closed loop washing system 204 of FIGS. 3-5. In this illustrated embodiment, the fluid recovery system 222 comprises a fluid or water separator 282, a mechanical filter 284, a particular filter 286, a water absorption device 288, and a cleaning fluid regeneration device 290. However, any combination of these elements 282, 284, 286, 288, and 290 and other fluid processing mechanisms are within the scope of the present technique. The illustrated fluid/water separator 282 may comprise fluid settling mechanisms (e.g., decanting), centrifuge mechanisms, distillation mechanisms, electrostatic based separators, and so forth. The filters 284 and 286 may comprise a variety of filtering mechanisms and different filtering capacities, such as a relatively coarse filter and a relatively fine particulate filter. For example, the mechanical filter 284 may have a mesh size in a range from about 50 microns to about 1000 microns, while the particulate filter 286 has a mesh size in a range from about 0.5 microns to about 50 microns. The water absorption device 288 may comprise a variety of water absorption mechanisms and materials, such as calcined clay. The cleaning fluid regeneration absorption device 290 may comprise an organic absorption mechanism to absorb dissolved organic impurities, such as fats and oils. For example, the organic absorption mechanisms may comprise activated carbon, carbon attitudes, clay, absorption resins (e.g., carbonaceous type resins), silica, alumina, and/or zeolites. The cleaning fluid regeneration absorption device 290 also may comprise a variety of forms, such as a packed bed column, a flat plate bed, a tortuous path bed, a membrane separator, and/or a column with packed trays.

Figure 7:
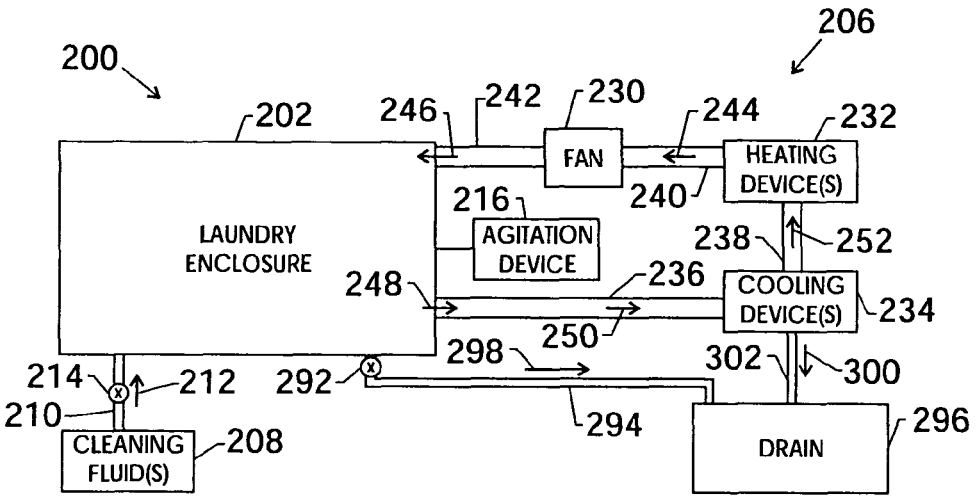
FIG. 7 is a block diagram illustrating another alternative embodiment of the integral laundry washing and drying systems illustrated in FIGS. 3-5 having a fluid drain.

FIG. 7 is a block diagram illustrating an alternative embodiment of the integral laundry washing and drying system 200 in accordance with certain embodiments of the present technique. As illustrated, the system 200 comprises the laundry enclosure 202, the tank of cleaning fluid 208 coupled to the laundry enclosure 202 via the fluid conduit 210, and the closed loop drying system 206 pneumatically coupled to the laundry enclosure 202. As illustrated by arrow 212, the integral laundry washing and drying system 200 engages the pump and/or valve 214 to transfer the cleaning fluid 208 into the laundry enclosure 202. In operation, the closed loop washing system 204 operates one or more washing cycles in which the cleaning fluid 208 is worked into laundry articles disposed within the laundry enclosure 202. For example, the integral laundry washing drying system 200 may engage the agitation device 216 to move or rotate the laundry articles within the laundry enclosure 202, thereby soaking the laundry articles with the cleaning fluid 208.

After sufficient agitation, the integral laundry washing and drying system 200 engages a pump and/or valve 292 to transfer the cleaning fluid 208 from the laundry enclosure 202 through a fluid conduit 294 to a fluid drain 296, as indicated by arrow 298. The integral laundry washing and drying system 200 also may rotate the laundry enclosure at a relatively high speed, thereby centrifuging the cleaning fluid 208 out of the laundry articles and into the fluid drain 296.

As discussed above, the closed loop drying system 206 of FIG. 7 comprises a blowing device or fan 230, one or more heating devices 232, and one or more cooling devices 234. The foregoing devices 230, 232, and 234 are pneumatically coupled to the laundry enclosure 202 and to one another via air conduits 236, 238, 240, and 242, thereby forming a closed-loop airflow indicated by arrows 244, 246, 248, 250, and 252. In operation, the closed loop drying system 206 blows heated air (e.g., airflows 244 and 246) from the one or more heating devices 232 into the laundry enclosure 202, thereby substantially evaporating the remaining cleaning fluid 208 within the laundry articles. As indicated by airflows 248 and 250, the closed loop drying system 206 then exhausts the vaporized or evaporated cleaning fluid 208 from the laundry enclosure 202 to the cooling devices 234. The cooling devices 234 operate to cool the heated airflow, thereby condensing a substantial portion of the vaporized or evaporated cleaning fluid 208 out of the airflow. As indicated by fluid flow 300, the closed loop drying system 206 transports the recovered cleaning fluid 208 from the cooling devices 234 to the fluid drain 296 through a fluid drain conduit 302. The closed loop drying system 206 then repeats as indicated by arrows 252 and 244. Accordingly, the closed loop drying system 206 repeatedly heats the airflow, evaporates the cleaning fluid 208 from the laundry enclosure 202, and cools the airflow to condense and drain the cleaning fluid 208 until the laundry articles are substantially dry.

Figure 8:
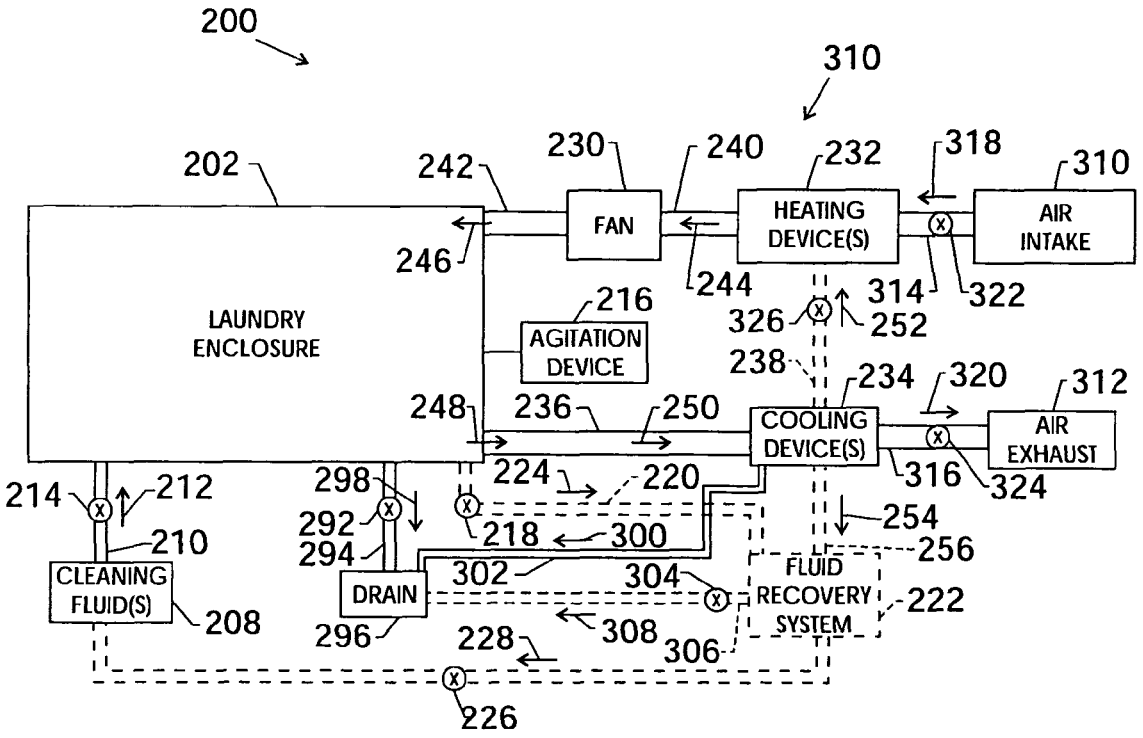
FIG. 8 is a block diagram illustrating another alternative embodiment of the integral laundry washing and drying systems illustrated in FIGS. 3-5 and 7 having an air intake and an air exhaust.

FIG. 8 is a block diagram illustrating an alternative embodiment of the integral laundry washing and drying system 200 in accordance with certain embodiments of the present technique. As illustrated by arrow 212, the integral laundry washing and drying system 200 engages the pump and/or valve 214 to transfer the cleaning fluid 208 into the laundry enclosure 202 for operation of one or more washing cycles. For example, the integral laundry washing drying system 200 may engage the agitation device 216 to move or rotate the laundry articles within the laundry enclosure 202, thereby soaking the laundry articles with the cleaning fluid 208. After sufficient agitation and cleansing, the integral laundry washing and drying system 200 can engage the pump and/or valve 292 to transfer the cleaning fluid 208 from the laundry enclosure 202 through the fluid conduit 294 to the fluid drain 296, as indicated by arrow 298. Again, the integral laundry washing and drying system 200 may rotate the laundry enclosure 202 at a relatively high speed, thereby centrifuging the cleaning fluid 208 out of the laundry articles and into the fluid drain 296.

Alternatively, as indicated by arrow 224, the integral laundry washing and drying system 200 can engage the optional fluid recovery pump and/or valve 218 to transfer the cleaning fluid 208 from the laundry enclosure 202 through the optional fluid conduit 220 to the optional fluid recovery system 222. After processing by the optional fluid recovery system 222, the optional pump and/or valve 226 operates to transfer the recovered cleaning fluid 208 from the fluid recovery system 222 to the tank of cleaning fluid 208, as indicated by arrow 228. In operation, the optional fluid recovery system 222 also may engage an optional drain pump and/or valve 304 to transfer impurities and other undesired fluids through an optional drain conduit 306 to the fluid drain 296, as indicated by arrow 308.

As illustrated in FIG. 8, the integral washing drying and system 200 also comprises a drying system 310 having the blowing device or fan 230, one or more heating devices 232, one or more cooling devices 234, an air intake 310, and an air exhausts 312. The fan 230, heating devices 232, and air intake 310 are pneumatically coupled to one another and to the laundry enclosure 202 via air conduits 314, 240, and 242. Similarly, the cooling devices 234 and air exhaust 312 are pneumatically coupled to one another and to the laundry enclosure 202 via air conduits 236 and 316. In operation, the drying system 310 draws air from the air intake 310, heats the air with the heating devices 232, and charges the heated air into the laundry enclosure 202, as indicated by airflows 318, 244, and 246. As the heated airflow circulates within the laundry enclosure 202, the drying system 310 substantially evaporates or vaporizes the remaining cleaning fluid 208 within the laundry articles. As indicated by airflows 248 and 250, the drying system 310 then discharges the vaporized or evaporated cleaning fluid 208 from the laundry enclosure 202 to the cooling devices 234. The cooling devices 234 operate to cool the heated airflow, thereby condensing a substantial portion of the vaporized or evaporated cleaning fluid 208 out of the airflow. As indicated by fluid flow 300, the drying system 310 drains the condensed cleaning fluid 208 from the cooling devices 234 to the fluid drain 296 through the fluid drain conduit 302. After condensing the evaporated cleaning fluid 208 from the airflow, the drying system 310 discharges the airflow through the air exhausts 312, as indicated by airflow 320.

The integral washing and drying system 200 of FIG. 8 also may have a variety of other optional features, such as those discussed above with reference to FIGS. 1-7. For example, the drying system 310 may comprise the air conduit 238 extending between the cooling devices 234 and the heating devices 232, thereby facilitating a closed loop airflow passing through the laundry enclosure 202. Optional air valves 322 and 324 function to shutoff the air intake 310 and the air exhaust 312 for operation of the drying system 310 as a closed loop airflow system. Additionally, optional air valve 326 functions to open the air conduit 238 for operation of the drying system 310 as a closed loop airflow system. The reverse position of the air valves 322, 324, and 326 enables the normal operation of the drying system 310 described in detail above.

In operation as a closed loop airflow system, the drying system 310 of FIG. 8 continuously and repeatedly circulates air through the heating devices 232, the laundry enclosure 202, and the cooling devices 234. As a result, the closed loop configuration of the drying system 310 heats the airflow, evaporates the cleaning fluid 208 from the laundry articles in the laundry enclosure 202, and cools the airflow to condense and drain the evaporated cleaning fluid 208 until the laundry articles are substantially dry. It also should be noted that the drying system 310 may operate without the heating devices 232, thereby relying on the forced airflow, fluid evaporation, and subsequent cooling-induced condensation of the fluid from the airflow.

In addition to the closed loop configuration of the drying system 310, the integral laundry washing drying system 200 of FIG. 8 may comprise the fluid recovery system 222. Accordingly, the cleaning fluid 208 condensed by the cooling devices 234 can either be drained to the fluid drain 296 and/or recovered by the fluid recovery system 222. The system 200 also may utilize a combination of these features, thereby allowing drainage of certain fluids (e.g., water, oils, fats, etc.) and recovery of other fluids (e.g., cleaning solvents). If the system 200 utilizes the fluid recovery system 222, then the cleaning fluid 208 condensed by the cooling devices 234 passes to the fluid recovery system 222 through the conduit 256, as indicated by flow 254. As discussed above, the fluid recovery system 222 generally recovers or reconditions the condensed cleaning fluid 208 to a state that is reusable for a subsequent washing cycling. Upon completion, the system 200 engages the pump and/or valve 226 to transfer the recovered cleaning fluid 208 from the fluid recovery system 222 to the tank of cleaning fluid 208, as indicated by arrow 228. During processing, the fluid recovery system 222 also may engage the drain pump and/or valve 304 to transfer impurities and other undesired fluids (e.g., water, fats, oils, etc.) through the drain conduit 306 to the fluid drain 296, as indicated by arrow 308.

Figure 9:
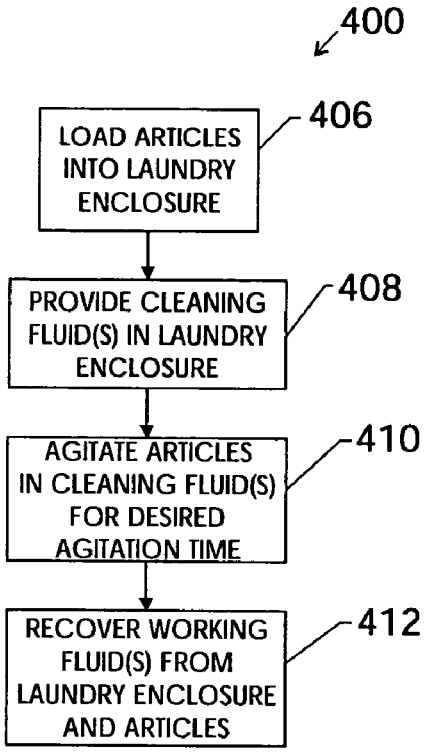
FIG. 9 is a flow chart illustrating an exemplary home laundry washing process of the laundry devices and systems illustrated in FIGS. 1-5 and 7-8 in accordance with certain embodiments of the present technique.
Figure 10:
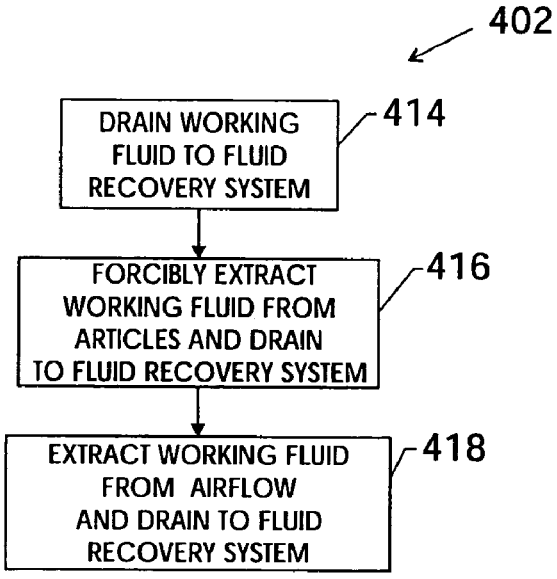
FIG. 10 is a flow chart illustrating an exemplary fluid recovery process of the home laundry washing process of FIG. 9 in accordance with certain embodiments of the present technique.
Figure 11:
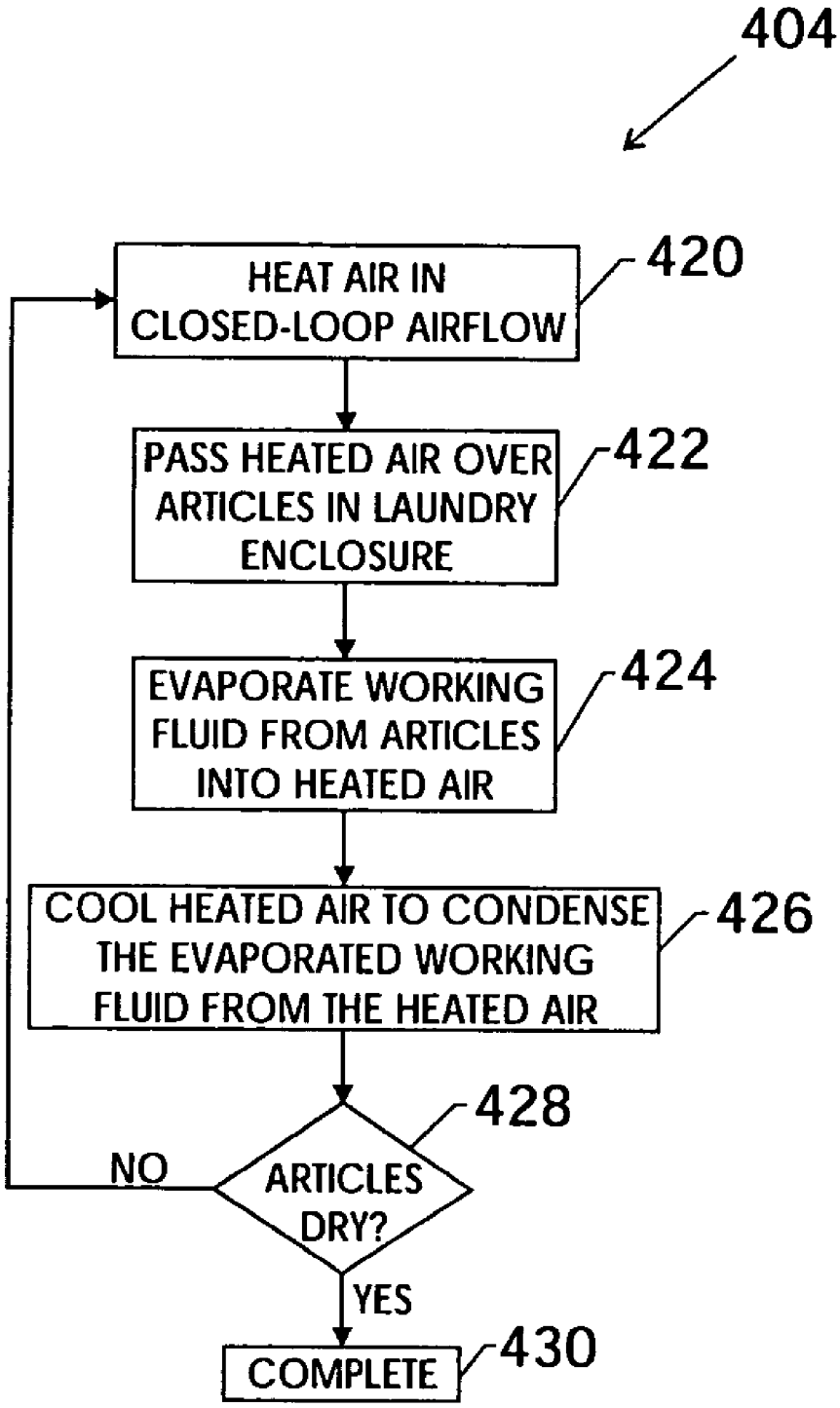
FIG. 11 is a flow chart illustrating an exemplary home laundry drying process of the laundry devices and systems illustrated in FIGS. 1-5 and 7-8 in accordance with certain embodiments of the present technique.

Turning now to FIGS. 9-11, exemplary processes 400, 402, and 404 for washing and drying laundry articles are provided for application with the systems described with reference to FIGS. 1-8. As indicated by blocks 406, 408, 410, and 412, the washing and drying process 400 of FIG. 9 comprises loading articles into a laundry enclosure, providing cleaning fluids in the laundry enclosure, agitating the articles in the cleaning fluids for a desired agitation time, and recovering the cleaning fluids from the laundry enclosure and the articles. For example, block 408 of the process 400 may charge the laundry enclosure with a solvent based cleaning fluid, such as cyclic siloxane. Other cleaning fluids also may be disposed within the laundry enclosure. At block 410, the process 400 may rotate the laundry enclosure in a clockwise and counterclockwise rotation for a time (e.g., two minutes) sufficient to ensure that the laundry articles are completely saturated with the cleaning fluid. Turning to block 412, the process 400 may perform a variety of techniques to remove the cleaning fluids from the laundry enclosure and the articles, such as described with reference to FIGS. 10 and 11.

As illustrated in FIG. 10, the process 402 comprises draining a working fluid (e.g., the cleaning fluid with impurities) from the laundry enclosure to a fluid recovery system (block 414). For example, the process 402 may engage the pump and/or valve 218 to transfer the working fluid to the fluid recovery system 222, as illustrated in FIGS. 3-5 and 8. The process 402 also comprises forcibly extracting the working fluid from the articles and draining the extracted fluid to the fluid recovery system (block 416). For example, the process 402 may rotate the laundry enclosure at relatively high speed (e.g., 350 to 750 rpm) for a time (e.g., 5 to 10 minutes) sufficient to centrifuge out a substantial portion of the retained working fluid within the laundry articles. For example, at the end of forcible extraction block 416, the laundry articles may have a fluid retention of between 20 and 40 percent. The process 402 also comprises extracting working fluid from the drying airflow passing through the laundry enclosure and over the laundry articles and, also, draining the extracted working fluid to the fluid recovery system (block 418). As described with reference to FIG. 11, the process 402 may perform a variety of airflow drying techniques to remove the working fluid.

The process 404 illustrated in FIG. 11 comprises heating air in a closed loop airflow, passing the heating air over the laundry articles in the laundry enclosure, evaporating working fluid from the articles into the heated air, and cooling the heated air to condense the evaporated working fluid from the heated air to the fluid recovery system, as indicated by blocks 420, 422, 424, and 426. Turning to block 420, the process 404 may comprise heating the air entering the laundry enclosure to a temperature ranging between about 100 to 170 degrees Fahrenheit. In certain embodiments, the air is heated to a range of 130 to 170 degree Fahrenheit. The airflow provided in block 422 may range between about 150 and 300 cubic feet per minute (CFM). However, the process 404 may provide any suitable heat and airflow to facilitate a desired rate and percentage of evaporation of the working fluid from the laundry articles. In block 426, the process 404 cools the airflow to a sufficiently cool temperature (e.g., 50 to 80 degrees Fahrenheit) to facilitate a desired rate and percentage of condensation of the evaporated working fluid. In certain embodiments, the air is cooled to approximately 60 to 70 degrees Fahrenheit. The fluid recovery system then processes the condensed working fluid for reuse by the washing and drying process 400. As the closed loop air drying process 404 continues, the process 404 queries whether the laundry articles are dry at block 428. For example, the process 404 may evaluate the airflow humidity or the fluid retention in the laundry articles. If the laundry articles are sufficiently dry, then the process 404 completes at block 430. Otherwise, the process 400 repeats at block 420.

Figure 12:
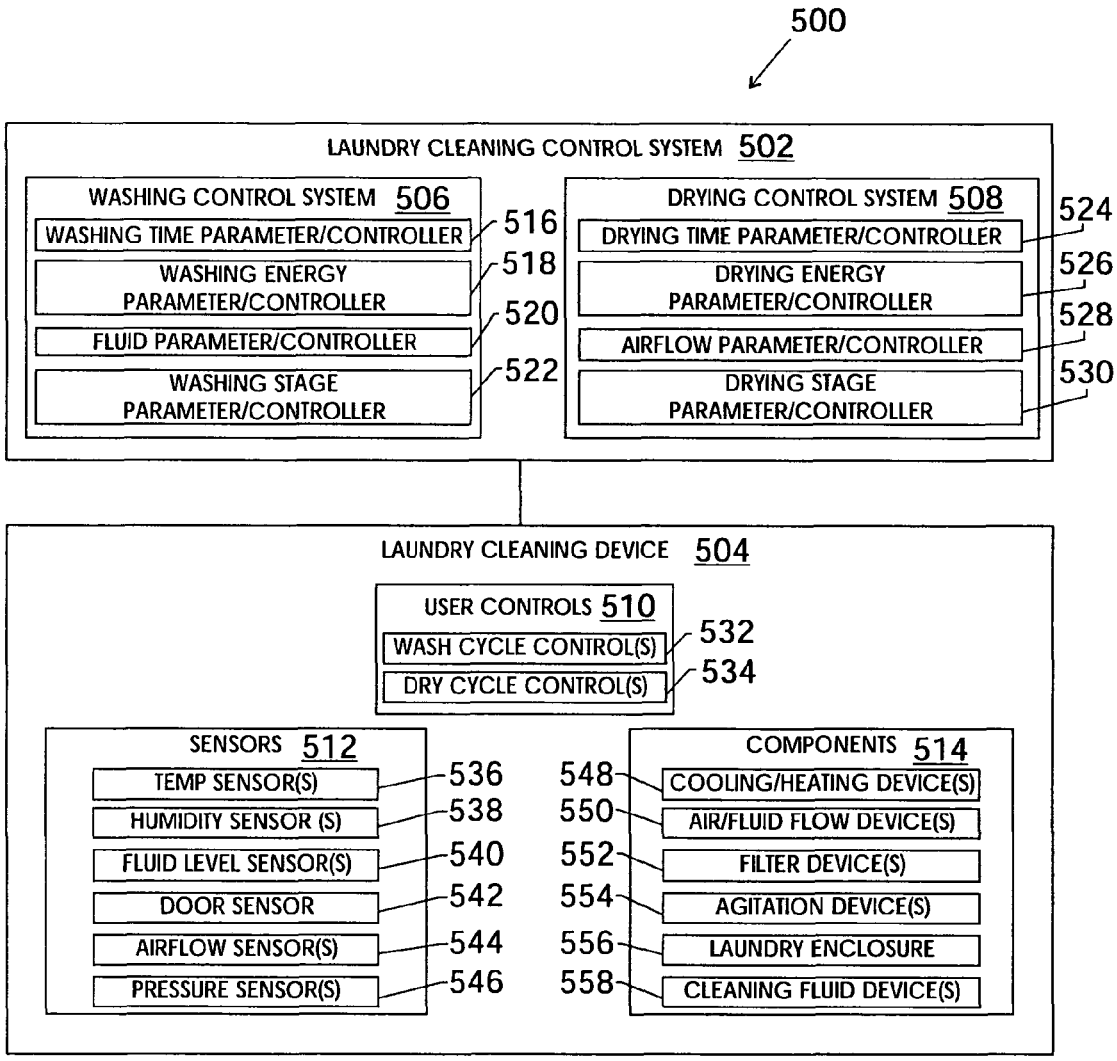
FIG. 12 is a block diagram illustrating an exemplary laundry cleaning control system for the laundry devices, systems, and processes illustrated in FIGS. 1-11 in accordance with certain embodiments of the present technique.

FIG. 12 is a block diagram illustrating an exemplary laundry cleaning system 500 comprising a laundry cleaning control system 502 operatively coupled to a laundry cleaning device 504. As illustrated, the laundry cleaning control system 502 comprises a washing control system 506 and a drying control system 508, which are operatively coupled to user controls 510, sensors 512, and components 514 of the laundry cleaning device 504. The illustrated washing control system 506 comprises a washing time control parameter and/or controller 516, a washing energy control parameter and/or controller 518, a fluid control parameter and/or controller 520, and a washing stage control parameter and/or controller 522. Similarly, the illustrated drying control system 508 comprises a drying time control parameter and/or controller 524, a drying energy control parameter and/or controller 526, and airflow control parameter and/or controller 528, and a drying stage control parameter and/or controller 530. Altogether, the foregoing washing parameters/controllers 516, 518, 520, and 522 and drying parameters/controllers 524, 526, 528, and 530 operate to control the overall cleaning time and effectiveness for various types of laundry, such as heavy loads, medium loads, light loads, different material colors (e.g., colors and whites), different materials (e.g., delicates), and so forth. The foregoing parameters/controllers also control the type of cleaning fluids (e.g., cleaning solvents, detergents, water, no water, etc.), the type of airflows (e.g., closed-loop airflow), fluid recovery (e.g., enabled or disabled), and other desired operational characteristics.

Turning to the laundry cleaning device 504 illustrated in FIG. 12, the user controls 510 may comprise a wide variety of wash cycle controls 532 and dry cycle controls 534. For example, the wash cycle controls 532 may comprise fluid selection (e.g., cleaning solvents, detergents, water, no water, etc.), agitation time controls, spin time controls, fluid recovery controls (e.g., enabled or disabled), fluid temperature controls, energy usage controls (e.g., energy efficient), and other such controls. Similarly, the dry cycle controls 534 may comprise dryness level controls, dry time controls, airflow controls, air heating controls, air cooling controls, fluid recovery controls (e.g., enabled or disabled), energy usage controls (e.g., energy efficient), and other such controls.

The sensors 512 of the laundry cleaning device 504 may comprise one or more temperature sensors 536, humidity sensors 538, fluid level sensors 540, door sensors 542, airflow sensors 544, and pressure sensors 546. These sensors 512 operate in conjunction with the user controls 510 and the components 514 of the laundry cleaning device 504 and, also, the subsystems 506 and 508 of the laundry cleaning control system 502. As illustrated, the components 514 comprise one or more cooling and/or heating devices 548, airflow and/or fluid flow devices 550, filter devices 552, agitation devices 554, laundry enclosure 556, and cleaning fluid devices 558. For example, different combinations of these components 514 may be configured in the laundry cleaning device 504, as described above with reference to FIGS. 1-11.

As described above with reference to FIGS. 1-12, the systems and processes 10, 200, 400, 402, 404, and 500 facilitate integral washing and drying of laundry articles in a home environment. The particular hardware and configuration settings are adapted to minimize both energy usage and cleaning time for the home environment. For example, an exemplary drying cycle may be in a range of between 15 and 60 minutes for a laundry load capacity ranging between about 2 and 15 pounds. In this scenario, the power usage to dry the laundry articles may range between 430 and 6300 Watts. For a laundry load capacity between about 6 and 12 pounds, the drying time may range between about 20 and 60 minutes. In this scenario, the power usage may range between 1300 and 5200 Watts. In each of these scenarios, these power ranges can easily be handled by a household circuit having common voltage and amperage ratings. For example, certain embodiments of the systems 10, 200, 400, 402, 404, and 500 may be configured for household circuits, such as 240 Volts and 30 amps, 220 Volts and 20 amps, 220 Volts and 30 amps, or 110 Volt and 15-20 amps.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A home laundry machine, comprising:

a laundry enclosure adapted to clean laundry in a cleaning fluid; and a drying mechanism pneumatically coupled to the laundry enclosure via an air inlet and an air outlet, comprising:

a vapor compression cycle system comprising a condenser, an evaporator, and a compressor disposed in a closed fluid path, wherein the condenser is configured to heat air upstream of the air inlet; and wherein the evaporator is configured to cool air downstream of the air outlet.

2. The home laundry machine of claim 1, wherein the drying mechanism is adapted to recapture a desired portion of the cleaning fluid.

3. The home laundry machine of claim 2, wherein the desired portion comprises a cleaning solvent.

4. The home laundry machine of claim 1, comprising a cleaning solvent tank coupled to the laundry enclosure.

5. The home laundry machine of claim 4, wherein the cleaning solvent tank retains a cleaning solvent comprising a siloxane.

6. The home laundry machine of claim 1, comprising an air conduit extending from the air outlet to the air inlet.

7. The home laundry machine of claim 6, comprising a blowing device adapted to flow air through a pneumatically closed air pathway extending through the air conduit, into the laundry enclosure from the air inlet, and out of the laundry enclosure through the air outlet.

8. The home laundry machine of claim 1, comprising a condensate drain disposed adjacent the cooling device and coupled to a fluid recovery system.

9. The home laundry machine of claim 1, wherein vapor compression cycle comprises a pressure reducing mechanism.

10. The home laundry machine of claim 1, comprising an agitation device coupled to the laundry enclosure.

11. The home laundry machine of claim 10, wherein the agitation device comprises a motor having a rotational shaft coupled to a rotational axis of the laundry enclosure.

12. The home laundry machine of claim 1, wherein the laundry enclosure is side-loadable.

13. The home laundry machine of claim 1, wherein the laundry enclosure is top-loadable.

14. The home laundry machine of claim 1, comprising a supplemental heating device configured to heat air upstream of the air inlet to supplement the heat provided by the condenser.

15. The home laundry machine of claim 1, comprising an airflow control configured to change the drying mechanism between a closed airflow system and an open airflow system relative to the atmosphere.

16. The home laundry machine of claim 1, comprising a wash control comprising a plurality of different cleaning fluid selections including a cleaning solvent, a cleaning detergent, and water.

17. The home laundry machine of claim 1, comprising a fluid recovery control configured to enable and disable fluid recovery of a cleaning fluid.

18. The home laundry machine of claim 1, comprising a fluid drain configured to drain waste water and a fluid recovery system configured to recapture a cleaning solvent.

19. The home laundry machine of claim 1, comprising control parameters having a target heated-air temperature greater than about 100 degrees Fahrenheit for the condenser.

20. The home laundry machine of claim 1, comprising control parameters having a target heated-air temperature between approximately 130 and 170 degrees Fahrenheit for the condenser.

21. The home laundry machine of claim 1, comprising control parameters having a target cooled-air temperature less than about 70 degrees Fahrenheit for the evaporator.

22. The home laundry machine of claim 1, comprising control parameters having a target cooled-air temperature between approximately 50 and 80 degrees Fahrenheit for the evaporator.

23. The home laundry machine of claim 1, comprising control parameters having a target airflow rate of about 150 to 300 cubic feet per minute through the laundry enclosure.

24. The home laundry machine of claim 1, wherein the condenser and the evaporator are both disposed in an air path between the air inlet and the air outlet.

* * * * *